United States Patent [19]

Nishida et al.

[11] 4,411,208

[45] Oct. 25, 1983

[54] EMBROIDERY FRAME FOR AUTOMATIC EMBROIDERY MACHINE

[75] Inventors: Koji Nishida; Taneichi Kawai, both of Anjo, Japan

[73] Assignee: Aisin Seiki Kabushiki Kaisha, Kariya, Japan

[21] Appl. No.: 289,994

[22] Filed: Aug. 4, 1981

[30] Foreign Application Priority Data

Aug. 5, 1980 [JP] Japan ..... 55-107322
Sep. 18, 1980 [JP] Japan ..... 55-133011

[51] Int. Cl.[3] ..... D05C 1/04; D05C 7/04; D05C 9/06

[52] U.S. Cl. ..... 112/103; 38/102.2; 112/121.12

[58] Field of Search ..... 112/103, 121.12; 38/102.2

[56] References Cited

U.S. PATENT DOCUMENTS 674,014 5/1901 Parkes ..... 112/103
1,120,357 12/1914 Austin ..... 38/102.2
2,989,015 6/1961 Taketomi ..... 112/103
3,443,536 5/1969 Rolauffs et al. ..... 112/103
4,247,998 2/1981 Foss ..... 38/102.2
4,280,420 7/1981 Nishida et al. ..... 112/103

*Primary Examiner*—Louis Rimrodt
*Attorney, Agent, or Firm*—Finnegan, Henderson, Farabow, Garrett & Dunner

[57] ABSTRACT

An embroidery frame for an automatic or programmed embroidery machine includes an outer frame member, an intermediate frame member and an inner frame member, all of circular configuration. The intermediate frame member is cut and provided with an adjusting or clamping screw so that it can be clamped around the inner frame member with a cloth held therebetween. The outer frame member is similar to the intermediate frame member and provided with an adjusting or clamping screw so that it is clamped around intermediate frame member. Further, the outer frame member is mounted on the traveller of the embroidery machine.

7 Claims, 3 Drawing Figures

EMBROIDERY FRAME FOR AUTOMATIC EMBROIDERY MACHINE

The present invention relates to an embroidery frame and more particularly to an embroidery frame for an automatic embroidery machine.

A conventional automatic embroidery machine includes an operating circuit which is adapted to receive signals from a memory device through a signal converting circuit for controlling the sewing machine motor and transferring servo-motors so as to locate the embroidery frame at desired positions with respect to the sewing needle. The embroidery frame generally comprises an inner frame member fitted to the inside of an outer frame member with a cloth held therebetween. The outer frame member is provided usually at the outer periphery with a bracket for connecting or securing the frame to a traveller of the machine. The traveller is mounted for movement along two perpendicularly crossing directions so that the embroidery frame can be placed at any desired position with respect to the sewing needle by appropriately actuating the transferring servo-motors.

In the conventional arrangements, however, inconveniencies have been encountered when the cloth on the embroidery frame has to be placed in a specific orientation. For example, where a cloth having a pattern is to be embroidered, it has to be placed at a specific orientation in the machine so that the embroidery pattern is correctly placed with respect to the previously formed pattern. In the conventional embroidery frame, the adjustment of the orientation of the cloth must be performed by loosening the inner frame and then adjusting the orientation. Thereafter, the cloth is properly stretched and the inner frame member is firmly fitted to the outer frame member. Thus, troublesome work and time have been consumed for the adjustment with the conventional embroidery frame.

It is therefore an object of the present invention to provide an embroidery frame which is convenient for adjustment of the orientation of the cloth with respect to the embroidery machine.

Another object of the present invention is to provide an embroidery frame in which the orientation of the cloth can be adjusted without releasing the cloth.

According to the present invention, the above and other objects can be accomplished by an embroidery frame for an embroidery machine which comprises an outer frame member having mounting means for removeably securing it to the machine, an intermediate frame member adapted to be fitted to the outer frame member along an inner periphery of the outer frame member, and an inner frame member adapted to be fitted to the intermediate frame member along an inner periphery of the intermediate frame member, said intermediate frame member having first adjusting means for adjusting its diametrical dimension so that a cloth to be embroidered can be held firmly between the intermediate and inner frame members, said outer frame member having second adjusting means for adjusting its diametrical dimensions so that it can be releasably fastened to the intermediate frame member. Preferably, one of the outer and intermediate frame members is formed with a circumferential guide groove and the other of the outer and intermediate frame members with at least one projection for engagement with the guide groove so that the outer frame member can be rotated with respect to the intermediate frame member when the outer frame member is loosened by the second adjusting means.

According to the features of the present invention, the embroidery frame is mounted on the machine through the mounting means provided on the outer frame member with a cloth held between the intermediate and inner frame members. When it is found that the cloth on frame is improperly oriented with respect to the machine, the second adjusting means on the outer frame member is loosened so as to make the intermediate frame member rotatable with respect to the outer frame member and the assembly of the intermediate and inner frame members is rotated with the cloth held therebetween so that the cloth is properly oriented with respect to the machine. The second adjusting means is then tightened to thereby fasten or clamp the outer frame member to the intermediate frame member.

The above and other objects and features of the present invention will become apparent from the following descriptions of a preferred embodiment taking reference to the accompanying drawings, in which.

Figure 1:
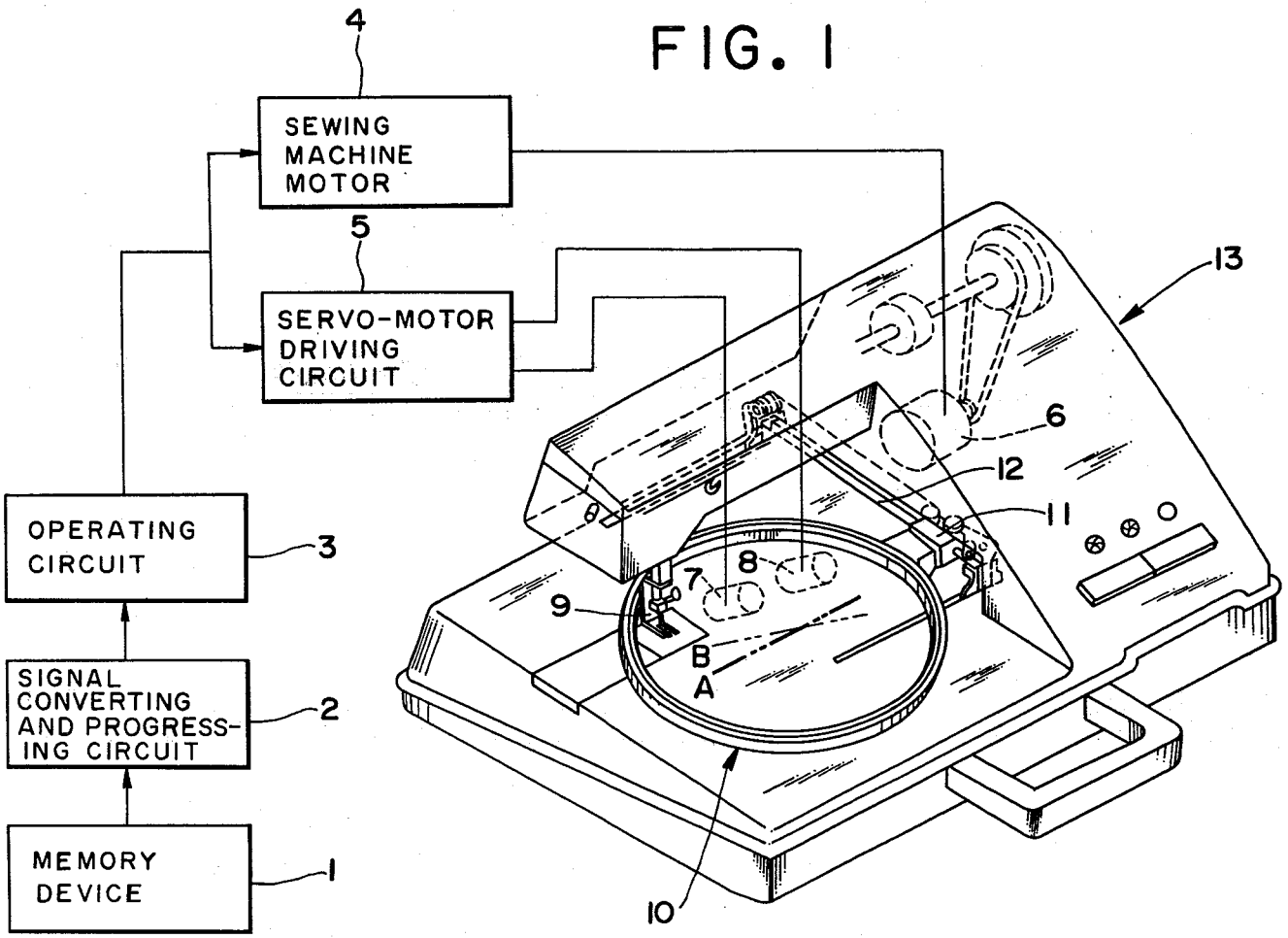
FIG. 1 is a perspective view of an automatic embroidering machine in which the frame in accordance with the present invention can be used.

Referring now to the drawings, particularly to FIG. 1, the embroidering machine shown therein includes a machine body 13 which carries a sewing machine motor 6, an X-axis transferring servo-motor 7 and a Y-axis transferring servo-motor 8. The motor 6 drives through an appropriate mechanism a sewing needle 9. An embroidery frame 10 is placed on the machine body 13 and secured to a traveller 11 which is mounted on a guide rod 12 for sliding movement therealong. The guide rod 12 extends in the Y-direction and is movable in the X-direction. The servo-motor 7 is adapted to drive the guide rod 12 in the X-direction and the servo-motor 8 is adapted to drive the traveller 11 in the Y-direction so that the frame 10 can be shifted to a desired position with respect to the machine body 13.

The embroidering machine includes a memory device 1 which has an output connected with a signal converting and processing circuit 2. The output of the circuit 2 is in turn connected with an operating circuit 3 which has outputs connected respectively with a sewing machine motor driving circuit 4 and a servo-motor driving circuit 5. The circuits 4 and 5 apply currents respectively to the machine motor 6 and the servo-motors 7 and 8 so that the sewing needle 9 and the traveller 11 are driven in accordance with the memory in the memory device. The general arrangements for such automatic or programmed embroidering machine are well known in the art so that detailed description will not be made.

Figure 2:
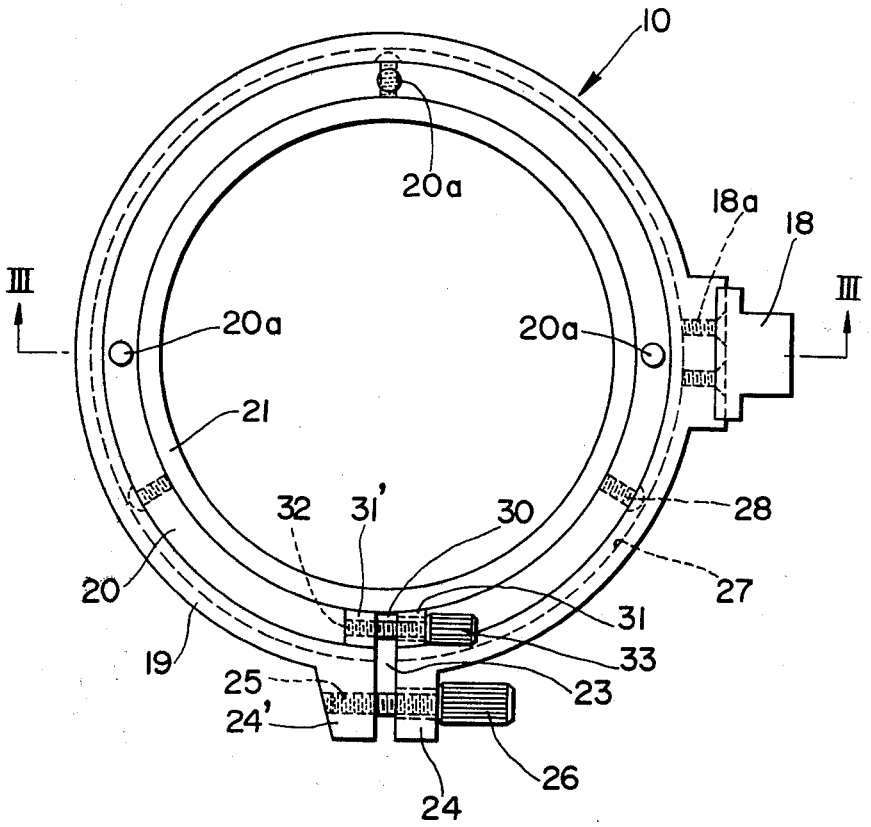
FIG. 2 is a plan view of the embroidery frame in accordance with one embodiment of the present invention; and, FIG. 3 is a sectional view of the frame shown in FIG. 2.
Figure 3:
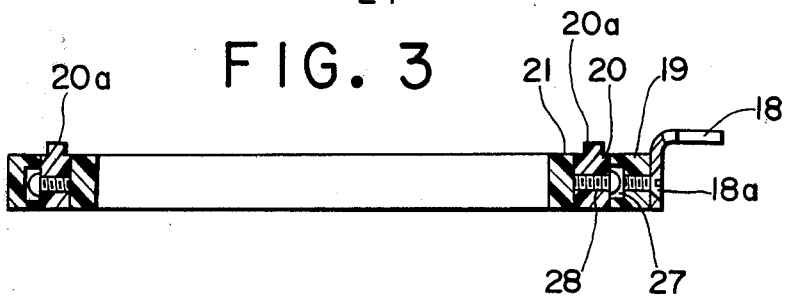

Referring now to FIGS. 2 and 3, there is shown an embroidering frame 17 which includes an outer frame member 19, an intermediate frame member 20 and an inner frame member 21. The outer frame member 19 has a mounting bracket 18 which is secured thereto by means of screws for mounting it on the traveller 11. The outer frame member 19 is generally of a circular configuration which is cut at a circumferential position to provide a pair of ends which are opposed to each other with a space 23 therebetween. At the opposed ends, the frame member 19 is formed with flanges 24 and 24'. The flanges 24' is formed with a screw threaded hole for engagement with a screw 25 whereas the flange 24 is formed with a plain hole for passing the screw 25 therethrough. The screw 25 has a head 26 so that the diameter of the outer frame member 19 can be adjusted by actuating the screw 25.

The intermediate frame member 20 is also of a generally circular configuration and is cut at a circumferential position to provide opposed ends where the frame member 20 is formed with upright flanges 31 and 31' with a space 30 therebetween. The flange 31 is formed with a plain hole for passing a screw 32 therethrough whereas the flange 31' is formed with a screw threaded hole for engagement with the screw 32. The screw 32 has an actuating head 33 so that the diameter of the intermediate frame member 20 can be adjusted by actuating the screw 32. As shown in FIG. 3, the outer frame member 19 is formed at the inner peripheral surface with a circumferential guide groove 27 and the intermediate frame member 20 has screws 28 which are threaded radially inwardly into the frame member 20 so that their heads projects from the outer periphery of the frame member 20. The intermediate frame member 20 is fitted to the inside of the outer frame member 19 so that the heads of the screws 28 on the intermediate frame member 20 are engaged with the guide groove 27 formed in the inner periphery of the outer frame member 19. The inner frame member 21 is of a circular configuration and fitted to the inside of the intermediate frame member 21.

In use, a cloth is held between the intermediate and inner frame members 20 and 21 and stretched across the circle of the inner frame member 21. The intermediate frame member 20 can be clamped to the inner frame member 21 by tightening the screw 32. The outer frame member 19 is then clamped to the intermediate frame member 20 by tightening the screw 25. The assembly of the frame members 19, 20 and 21 is then mounted on the machine body 13 by connecting the mounting bracket 18 to the traveller 11.

If it is then found that the cloth is not properly oriented for example as shown by line B with respect to a correct orientation shown by a line A, the screw 25 is loosened so that the intermediate frame member 20 can be rotated with respect to the outer frame member 19. Then, the assembly of the intermediate and inner frame members 20 and 21 is rotated to put the cloth into the correct orientation. Thereafter, the screw 25 is tightened to clamp the intermediate frame member 20 to the outer frame member 19. It will thus be understood that it is not necessary to loosen the screw 32 so that adjustment of the orientation of the cloth can be performed very conveniently.

When the cloth is put on the frame, the marginal portion of the cloth covers the outer and intermediate frame members 19 and 20 so that it is difficult to find the location of the cloth with respect to the frame member 20. The frame member 20 may therefore be formed with one or more projections **20*a* as shown in FIGS. 2 and 3. The projections 20*a* will be recognizable even when the frame member 20** is covered by the marginal portion of the cloth so that centering of the cloth can be conveniently performed.

The invention has thus been shown and described with reference to a specific embodiment, however, it should be noted that the invention is in no way limited to the details of the illustrated structures but changes and modifications may be made without departing from the scope of the appended claims.

We claim:

1. An embroidery frame for an embroidery machine having a traveller comprising:

an annular outer frame member with an adjustable circumference, said outer frame member having mounting means for removably securing the outer frame member to the traveller of the machine, an annular intermediate frame member with an adjustable circumference, said intermediate frame member being sized to fit within the outer frame member along the inner periphery of the outer frame member, an inner frame member, said inner frame member being sized to fit within the intermediate frame member along the inner periphery of the intermediate frame member, first adjusting means on the intermediate frame member for adjusting the circumference of the intermediate frame member to releasably clamp the intermediate frame member against the inner frame member so that a cloth to be embroidered can be held firmly between the inner frame member and the intermediate frame member, alignment means for holding the intermediate frame member within the outer frame member while still permitting the intermediate frame member to rotate relative to the outer frame member so that, when the outer frame member is mounted on the machine, the intermediate and inner frame members, and any cloth held by those members, can be freely rotated to properly orient the frame members and cloth relative to the machine, and second adjusting means of the outer frame member for adjusting the circumference of the outer frame member to releasably clamp the outer frame member against the intermediate frame member so that all frame members and any cloth held by the frame members are fixed relative to the machine's traveller.

2. The embroidery frame of claim 1 wherein the alignment means comprises:

a circumferential guide groove formed on one of said outer and intermediate frame members and at lesast one projection on the other of said outer and intermediate frame members, said projection riding within said guide groove.

3. The embroidery frame of claim 2 wherein said projection is provided by a head of a screw which is threaded radially into said other frame member.

4. The embroidery frame of claim 1 wherein said intermediate frame is split at a circumferential position to provide opposed ends, opposed flanges are formed at the opposed ends, and said first adjusting means includes a screw inserted through one of said flanges and threaded into the other of said flanges.

5. The embroidery frame of claim 1 wherein the outer frame is split at a circumferential portion to provide opposed ends, opposed flanges are formed at the opposed ends, and said second adjusting means includes a screw inserted through one of said flanges and threaded into the other of said flanges.

6. The embroidery frame of claim 1 further comprising at least one projection formed on the upper surface of said intermediate frame to permit a machine operator to easily find the location of the intermediate frame and properly center a cloth held by the frame.

7. The embroidery frame for an embroidery machine having a traveller comprising:

an annular outer frame member being split at a circumferential position to provide opposed ends, said annular outer frame member having mounting means for removably securing the outer frame member to the traveller of the machine, an annular intermediate frame member sized to fit within the outer frame member along the inner periphery of the outer frame member, said intermediate frame member being split at a circumferential position to provide opposed ends, outer frame flanges formed at the opposed ends of the outer frame, inner frame flanges formed at the opposed ends of the inner frame, a first adjusting means including a screw inserted through one of the intermediate frame flanges and threaded into the other of the intermediate frame flanges to releasably clamp the intermediate frame member against the inner frame member so that a cloth to be embroidered can be held firmly between the inner frame member and the intermediate frame member, a circumferential groove formed along the inner periphery of the outer frame member, at least a pair of projections on the outer periphery of said intermediate frame member and riding within the circumferential guide groove to hold the intermediate frame member within the outer frame member while still permitting the intermediate frame member to rotate relative to the outer frame member so that, when the outer frame member is mounted on the machine, the intermediate and inner frame members, and any cloth held by those members, can be freely rotated to properly orient the frame members and cloth relative to the machine, and a second adjusting means including a screw inserted through one of the outer frame flanges and threaded into the other of the outer frame flanges for adjusting the circumference of the outer frame member to releasably clamp the outer frame member against the intermediate frame member so that all frame members and any cloth held by the frame members are fixed relative to the machine's traveller.

* * * * *